US010036131B2

(12) United States Patent
Pascetta

(10) Patent No.: US 10,036,131 B2
(45) Date of Patent: Jul. 31, 2018

(54) METHOD FOR WATERPROOFING A BRIDGE EXPANSION JOINT

(71) Applicant: Russell Pascetta, North Providence, RI (US)

(72) Inventor: Russell Pascetta, North Providence, RI (US)

( * ) Notice: Subject to any disclaimer, the term of this patent is extended or adjusted under 35 U.S.C. 154(b) by 0 days.

(21) Appl. No.: 15/804,896

(22) Filed: Nov. 6, 2017

(65) Prior Publication Data

US 2018/0127931 A1 May 10, 2018

Related U.S. Application Data

(60) Provisional application No. 62/417,855, filed on Nov. 4, 2016.

(51) Int. Cl.

| | |
|---|---|
| ***E01C 11/06*** | (2006.01) |
| ***E01D 21/00*** | (2006.01) |
| ***E01D 19/06*** | (2006.01) |
| ***E01D 22/00*** | (2006.01) |
| *E01D 19/08* | (2006.01) |

(52) U.S. Cl.

CPC ..... *E01D 21/00* (2013.01); *E01C 11/06* (2013.01); *E01D 19/06* (2013.01); *E01D 22/00* (2013.01); *E01D 19/083* (2013.01)

(58) Field of Classification Search

CPC ..... E01C 11/02; E01C 11/04; E01C 11/045; E01C 11/06; E01D 19/06; E01D 19/083

USPC ..... 14/73.1; 404/56, 64, 67, 69

See application file for complete search history.

(56) References Cited

U.S. PATENT DOCUMENTS

| | | | | |
|---|---|---|---|---|
| 4,015,302 A * | 4/1977 | Clark | E01D 19/06 14/73.1 |
| 5,185,013 A * | 2/1993 | Martin | E01C 11/005 156/94 |
| 5,513,925 A * | 5/1996 | Dempsey | B32B 7/02 404/17 |
| 5,735,095 A * | 4/1998 | DeGroot | F16J 15/00 404/67 |
| 5,935,683 A * | 8/1999 | Iiyama | B29C 70/508 428/141 |
| 6,450,729 B1 * | 9/2002 | Clapp | E01C 11/005 404/75 |
| 6,619,879 B1 * | 9/2003 | Scuero | E02B 3/16 404/72 |
| 7,597,503 B2 * | 10/2009 | Hinding | E01C 11/005 404/75 |

(Continued)

*Primary Examiner* — Gary S Hartmann

(57) ABSTRACT

A method of waterproofing a bridge expansion joint, gap between a pair of bridge decks or a bridge deck and a ground deck, implemented through a layer of primer, an elastic membrane, a waterproofing membrane, a reinforced membrane, and a repaving process. As the first step, the layer of primer is applied to adjacent ends of the pair of bridge decks or the bridge deck and the ground deck. The elastic membrane is then shaped to an inverted dome and positioned within the gap as terminal ends of the elastic membrane are thermally bonded to the layer of primer. The waterproofing membrane is then thermally bonded to the layer of primer and the elastic membrane. Then, the reinforced membrane is thermally bonded onto the waterproofing membrane along the bridge expansion joint. The repaving process is then executed to install an asphaltic plug, completing the waterproofing of the bridge expansion joint.

14 Claims, 22 Drawing Sheets

(56) References Cited

U.S. PATENT DOCUMENTS 8,367,569 B2 * 2/2013 Wheatley ..... C04B 28/02
442/312
8,534,954 B2 * 9/2013 Geary ..... E01C 5/12
404/31
8,826,481 B1 * 9/2014 Haydu ..... E01D 19/06
14/73.5

* cited by examiner

METHOD FOR WATERPROOFING A BRIDGE EXPANSION JOINT

The current application claims a priority to the U.S. Provisional Patent application Ser. No. 62/417,855 filed on Nov. 4, 2016.

FIELD OF THE INVENTION

The present invention relates generally to a method for waterproofing a bridge expansion joint. More particularly, the present invention includes primer and multiple membranes which are applied and installed on the bridge expansion joint in a specific method to waterproof the bridge expansion joint.

BACKGROUND OF THE INVENTION

Bridge expansion joints are designed to allow for continuous traffic between structures while accommodating movement, shrinkage, and temperature variations on reinforced and prestressed concrete, composite, and steel structures. The Bridge expansion joints stop the bridge from bending out of place in extreme conditions, and also allow enough vertical movement to permit bearing replacement without the need to dismantle the bridge expansion joint. The combination of chlorides and moisture cause a deterioration effect on bridges which can later lead to catastrophic failures of the bridge. Chlorides and moisture penetrate into the concrete and then lead into the steel reinforcing bars; causing the steel reinforcing bars to corrode and which slowly deforms the bridge structure decreasing the overall stability.

The small movement joints currently in use utilize a method commonly called an Asphaltic Plug Joint (APJ). An Asphaltic Plug Joint System is a blended, hot-applied product composed of a formulated polymer modified asphalt binder and selected aggregate. The hot applied material is poured over a foam backer rod which has been inserted into the bridge's expansion joint gap and covered over with a thin steel plate. This method has many times proved to be unreliable for waterproofing. Bridge decks, typically made of concrete are going to expand and contract slightly for a number of reasons, including temperature changes, shrinkage of the concrete, settlement, ice and even the weight of vehicles. Bridge expansion joints are what allow the concrete to naturally expand and contract without cracking. The expansion joints are placed at the end of a bridge where it meets up with the road. These joints give the concrete just enough space to move and avoid concrete cracks. Even though there has been some significant advancement to increase the chances of the bridge not failing due to the deterioration effects from chlorides and moisture though the bridge expansion joints, the existing bridges still show signs of deformation thus showing the ineffectiveness of those methods.

It is therefore an objective of the present invention to provide a method for waterproofing a bridge expansion joint, utilizing the same APJ technique, but eliminating the foam backer rod and thin steel plate, and replacing those elements with the method of the present invention. The method includes a primer and multiple membranes, which are applied and installed on the bridge expansion joint, to provide protection from chlorides and moisture ultimately preventing deterioration and deformation of the bridge structure. The primer and the multiple membranes are applied and installed in a specific method allowing the present invention to effectively waterproof the bridge expansion joint.

DETAIL DESCRIPTIONS OF THE INVENTION

All illustrations of the drawings are for the purpose of describing selected versions of the present invention and are not intended to limit the scope of the present invention.

The present invention is a method for waterproofing a bridge expansion joint 1 so that the present invention can prevent penetrating chlorides and moisture into the bridge expansion joint 1. As a result, the present invention is able to protect steel reinforcing bars on a bridge structure that can be easily corroded or deteriorated with chlorides and moisture with multi-layered membranes. Implementation of the present invention hereinafter explains in relation to the bridge expansion joint 1 on the bridge structure, wherein the bridge expansion joint 1 is a gap 2 between a pair of bridge decks or a bridge deck and a ground deck (Step A). For example, the ground deck is understood as the road or pavement where the bridge structure meets the ground surface.

Figure 1:
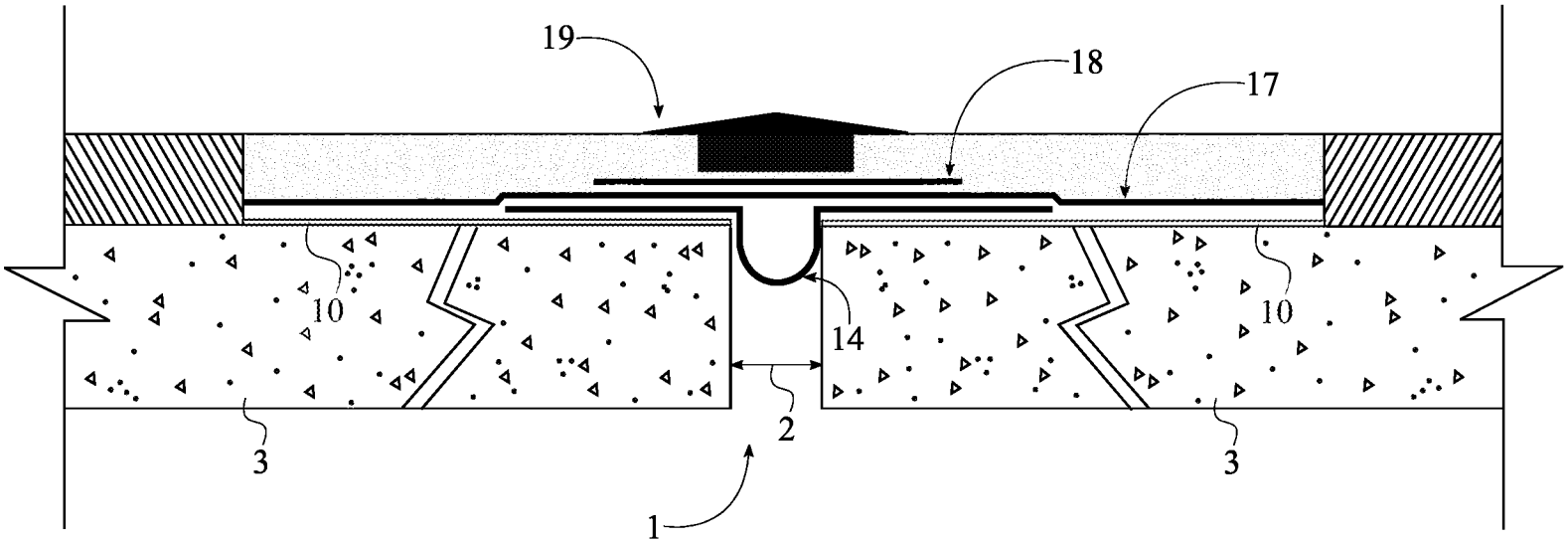
FIG. 1 is a schematic illustration showing the completion of the present invention.
Figure 11:
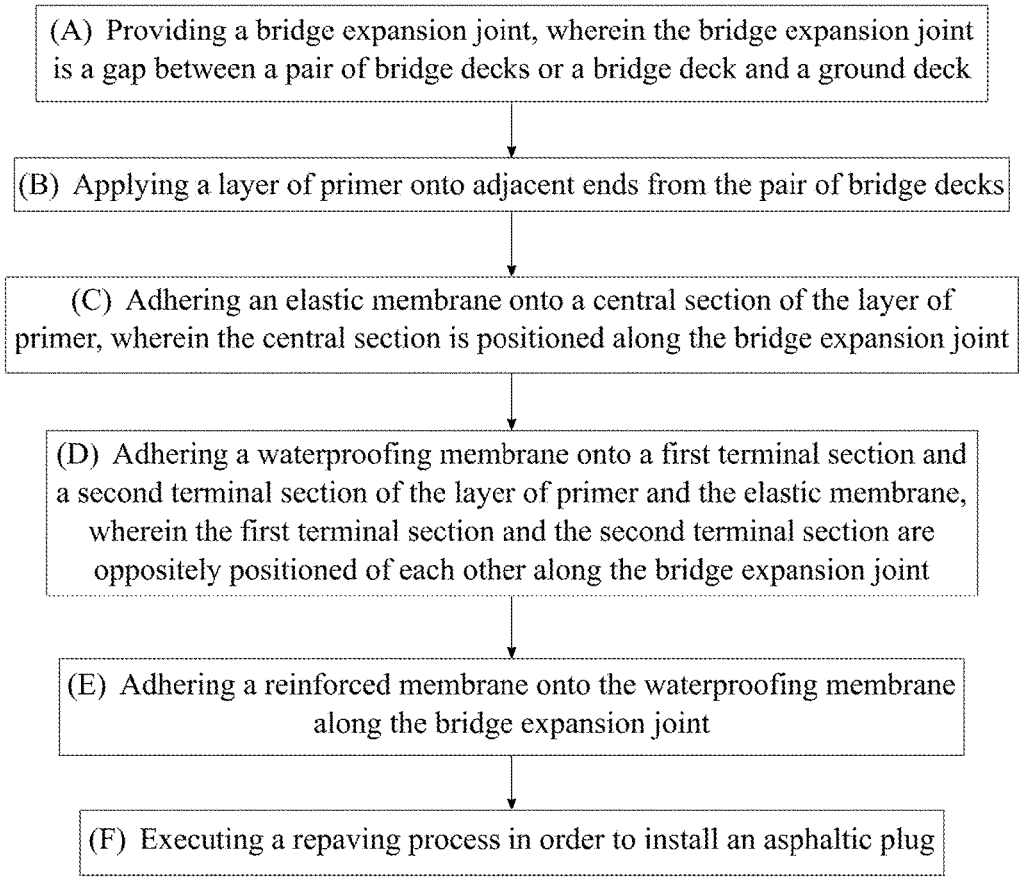
FIG. 11 is a basic flow chart showing the overall method of the present invention.

In reference to FIG. 1 and FIG. 11, as the first step, a layer of primer 10 is applied onto adjacent ends 3 from the pair of bridge decks or the bridge deck and the ground deck through a roller, brush, or spray (Step B). The layer of primer 10 enhances the bonding properties of the multi-layered membranes within the present invention. The layer of primer 10 is left on the adjacent ends 3 for a certain amount of time, which varies based on factors such as environmental conditions, before advancing to next step of the present invention. Once the layer of primer 10 turns a darker color compare to an initial color that is displayed during the application of the layer of primer 10, the change of color signifies that the adjacent ends 3 are ready to receive the multi-layered membranes. In the preferred method of the present invention, the layer of primer 10 is applied for minimum of six feet wide across the adjacent end. However, the applying width for the layer of primer 10 is not limited to six feet and can be any desired width upon engineering specification. The primer can be any type of primer that is a quick drying liquid primer. In the preferred embodiment of the present invention, the primer is a water based emulsion and ensures exemplary adhesion of the multi-layered membranes to the pair of bridge decks or the bridge deck and the ground deck.

Figure 2:
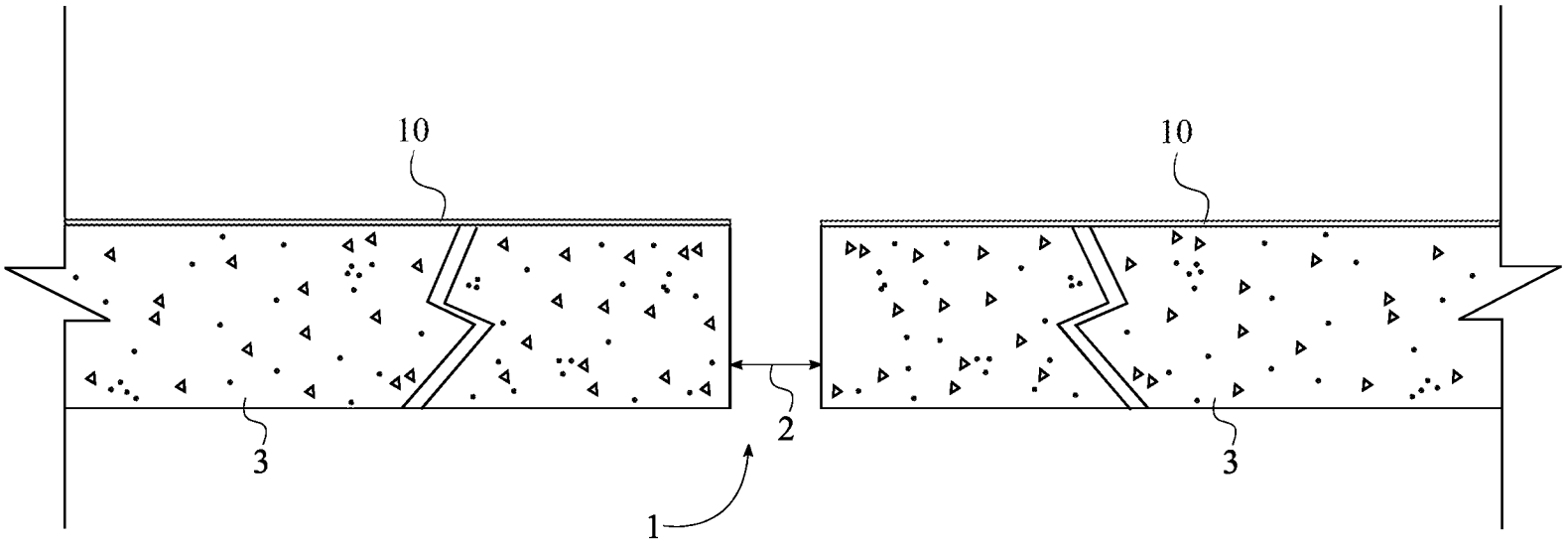
FIG. 2 is a schematic illustration showing application for the layer of primer within the present invention for new construction.
Figure 3:
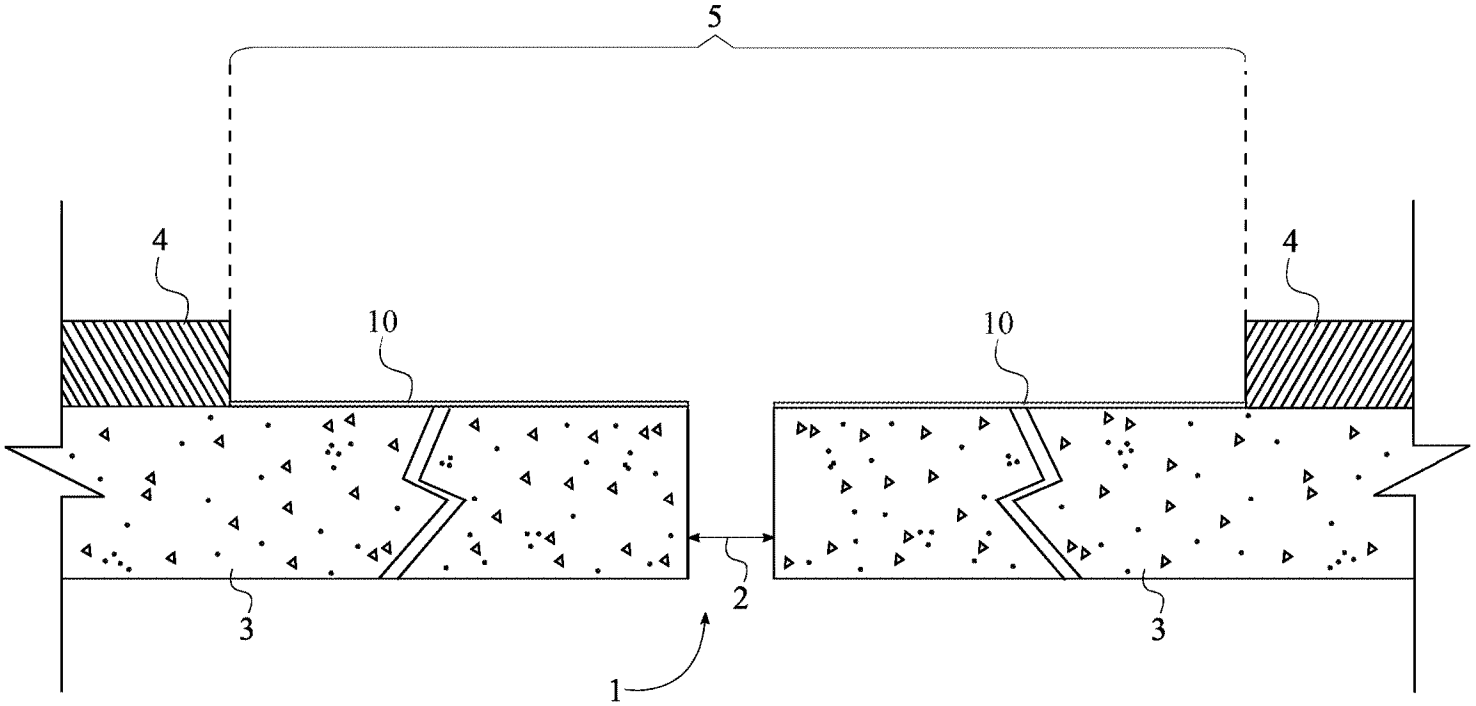
FIG. 3 is a schematic illustration showing application for the layer of primer within the present invention for old construction.
Figure 12:
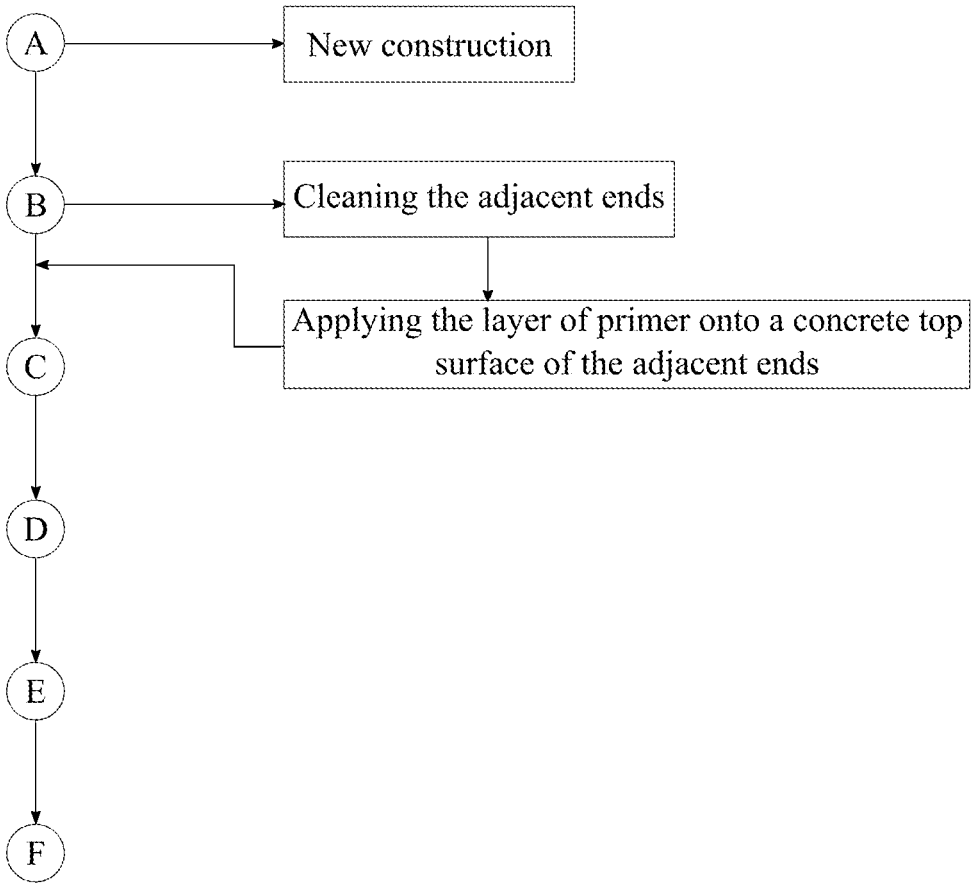
FIG. 12 is a basic flow chart showing the application for layer of primer within overall method of the present invention for new construction.
Figure 13:
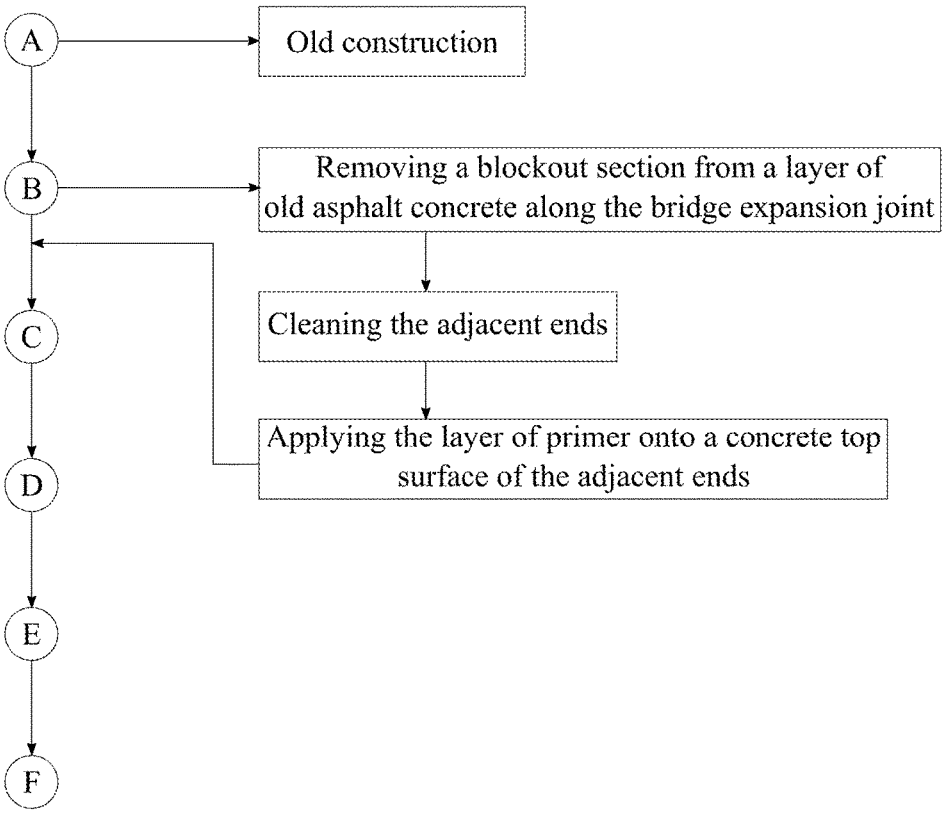
FIG. 13 is a basic flow chart showing the application for layer of primer within overall method of the present invention for old construction.

The present invention can be implemented to new construction or old construction of the adjacent ends 3 to execute Step B. In reference to FIG. 2 and FIG. 12, when the present invention is implemented to new construction, the layer of primer 10 is applied onto a concrete top surface of the adjacent ends 3. The rest of the steps of the present invention can then be executed. In reference to FIG. 3 and FIG. 13, when the present invention is implemented to old construction, a blockout section 5 from a layer of old asphalt concrete 4 that covers the adjacent ends 3 has to be removed along the bridge expansion joint 1 to execute Step B. Once the blockout section 5 is removed from the layer of old asphalt concrete 4, a concrete top surface of the adjacent ends 3 can be exposed. If there are any visible damages to the concrete top surface of the adjacent ends 3, repairs can be done to correct those damages since the concrete top surface is now visible and accessible. The layer of primer 10 is then applied onto the concrete top surface of the adjacent ends 3 thus allowing to execute rest of the steps of the present invention.

Figure 4:
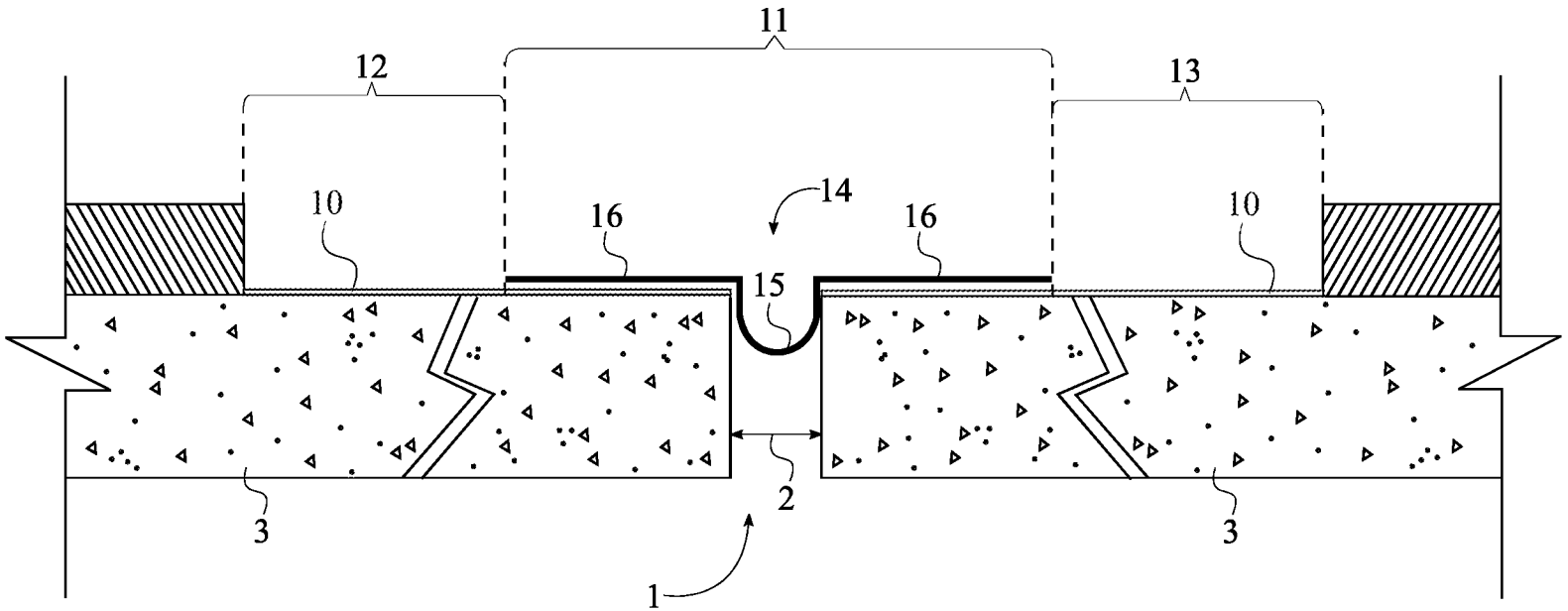
FIG. 4 is a schematic illustration showing adhering for the elastic membrane within the present invention.
Figure 14:
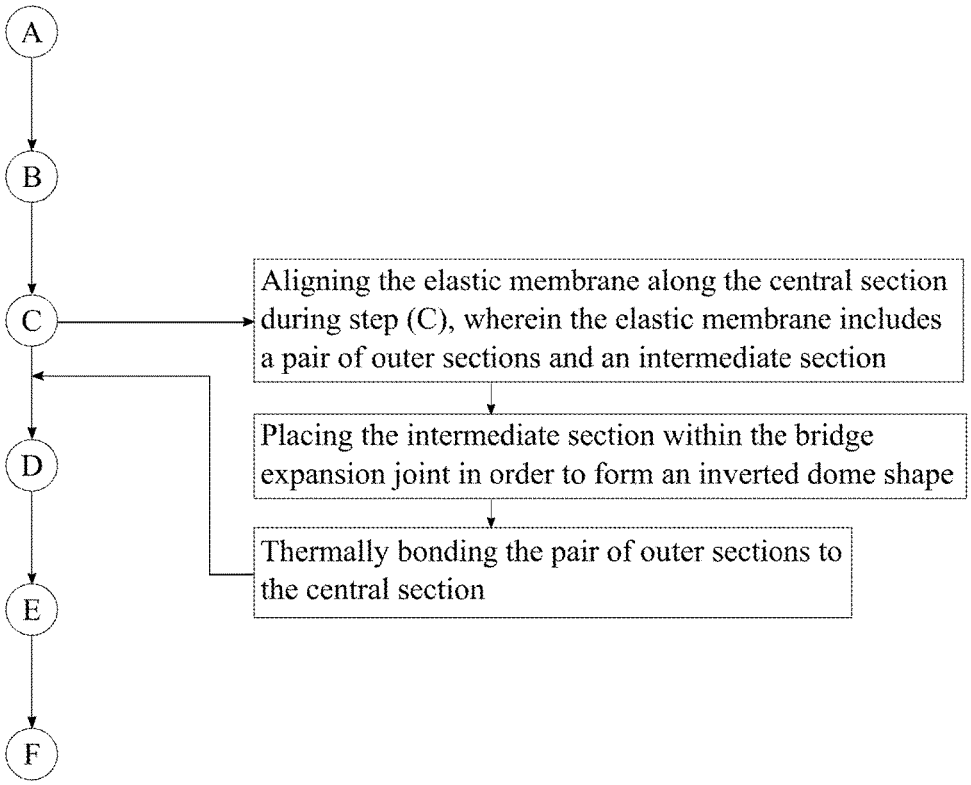
FIG. 14 is a basic flow chart illustrating the adhering of the elastic membrane within the overall method of the present invention.

In reference to FIG. 4 and FIG. 14, as the second step, an elastic membrane 14 is adhered onto a central section 11 of the layer of primer 10 so that the elastic membrane 14 is able to keep chlorides and moisture out of the bridge expansion joint 1 (Step C). The layer of primer 10 includes a first terminal section 12 and a second terminal section 13 in addition to the central section 11. The central section 11 is positioned along the bridge expansion joint 1 as the first terminal section 12 and the second terminal section 13 are oppositely positioned of each other along the bridge expansion joint 1. In other words, the central section 11 is positioned in between the first terminal section 12 and the second terminal section 13. More specifically, the elastic membrane 14 that includes a pair of outer sections 16 and an intermediate section 15 is aligned along the central section 11. The intermediate section 15 is then placed within the bridge expansion joint 1 in order to form an inverted dome shape. In the preferred method of the present invention, the inverted dome shaped is formed with a rebar that traverses the elastic membrane 14 into the bridge expansion joint 1. The pair of outer sections 16 is then thermally bonded to the central section 11 with a heat torch to complete the adhering process of the elastic membrane 14.

Figure 19:
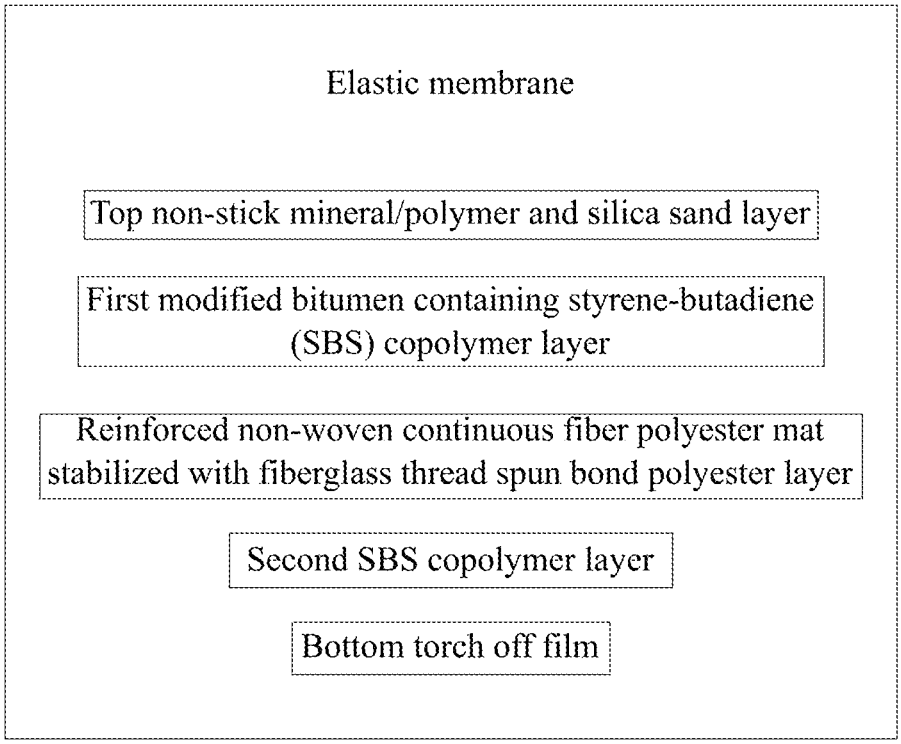
FIG. 19 is an illustration showing different layers of the elastic membrane.

Additionally, the elastic membrane 14 comprises a top non-stick mineral/polymer and silica sand layer, a first modified bitumen containing styrene-butadiene (SBS) copolymer layer, a reinforced non-woven continuous fiber polyester mat stabilized with fiberglass thread spun bond polyester layer, a second SBS copolymer layer, and a bottom torch off film as shown in FIG. 19. More specifically, the top non-stick mineral/polymer and silica sand layer is exposed to surrounding and provides a protective layer for the elastic membrane 14. The bottom torch off film is positioned adjacent to the layer of primer 10 thus allowing the heat torch to bond the elastic membrane 14 to the layer of primer 10. The first SBS copolymer layer, the reinforced non-woven continuous fiber polyester mat stabilized with fiberglass thread spun bond polyester layer, and the second SBS copolymer layer are respectively connected to each other from the top non-stick mineral/polymer and silica sand layer to the bottom torch off film thus forming the elastic membrane 14.

Figure 5:
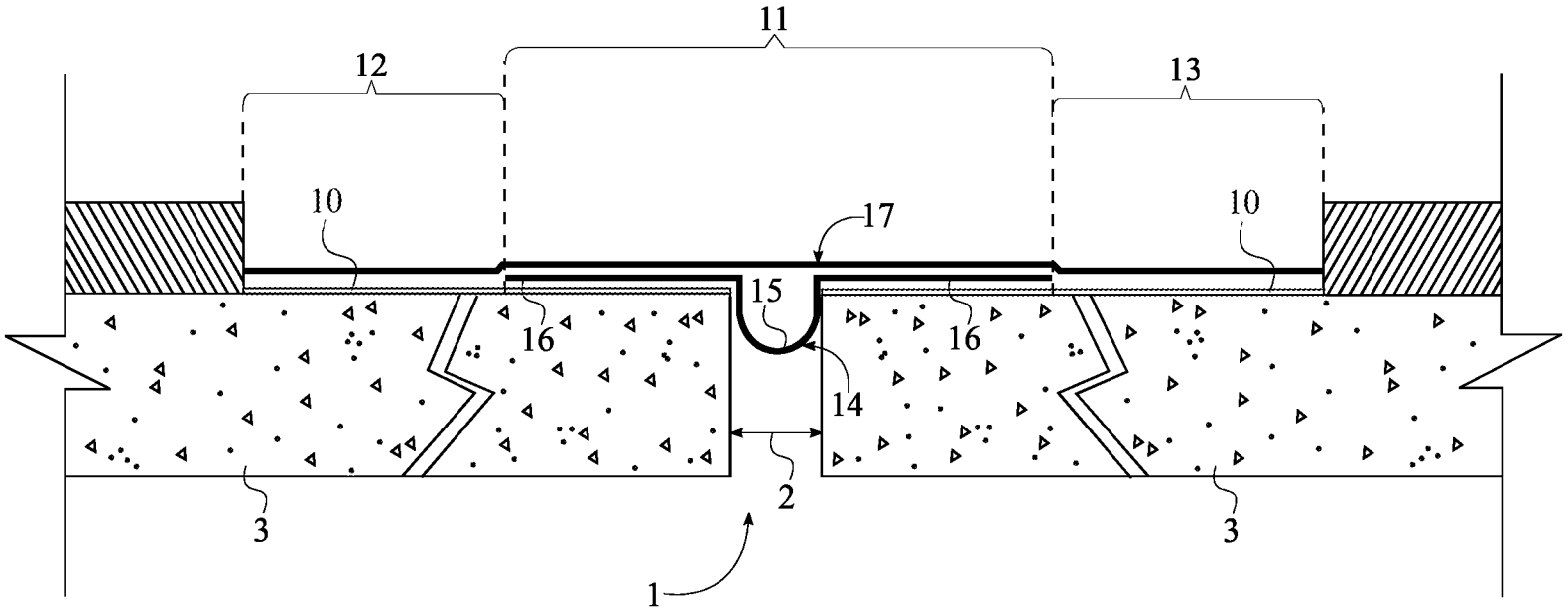
FIG. 5 is a schematic illustration showing adhering for the waterproofing membrane within the present invention.
Figure 15:
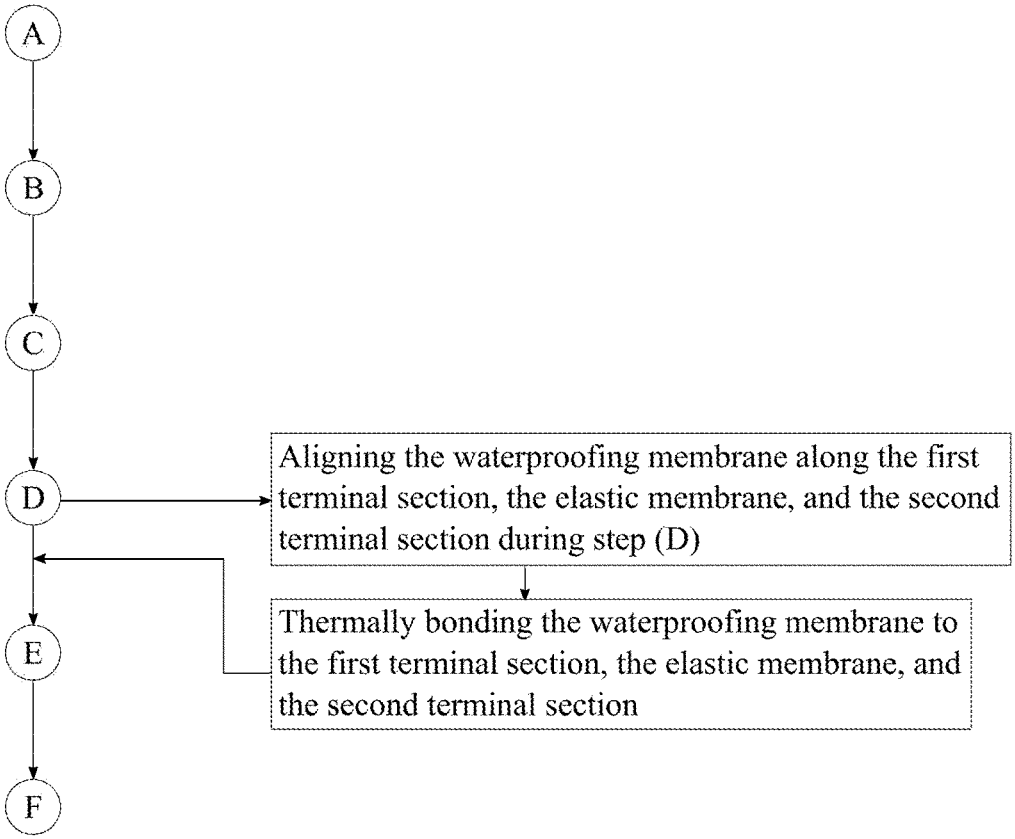
FIG. 15 is a basic flow chart illustrating the adhering of the waterproofing membrane within the overall method of the present invention.

In reference to FIG. 5 and FIG. 15, as the third step, a waterproofing membrane 17 is adhered onto the first terminal section 12, the elastic membrane 14, and the second terminal section 13 so that the waterproofing membrane 17 is able to keep out chlorides and moisture out of the bridge expansion joint 1 and the elastic membrane 14 (Step D). More specifically, the waterproofing membrane 17 is aligned along the first terminal section 12, the elastic membrane 14, and the second terminal section 13 so that the waterproofing membrane 17 is able to fully covers the layer of primer 10. The waterproofing membrane 17 is then thermally bonded to the first terminal section 12, the elastic membrane 14, and the second terminal section 13 with the heat torch to complete the adhering process of the waterproofing membrane 17. Optionally, the waterproofing membrane 17 may be installed over the entire span of the bridge structure or about the bridge expansion joint on new construction.

Figure 20:
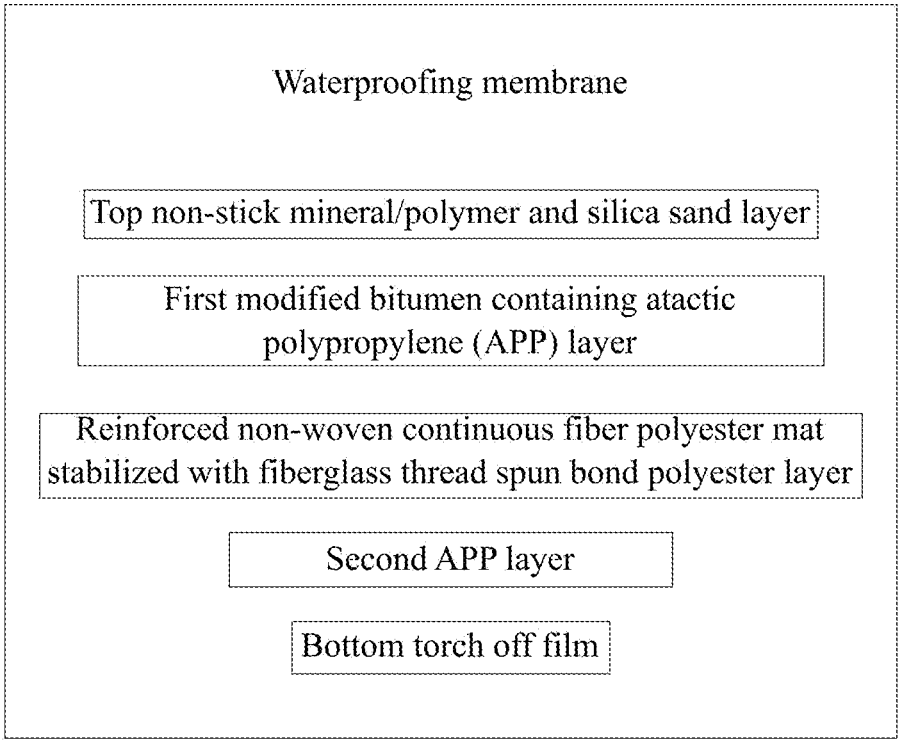
FIG. 20 is an illustration showing different layers of the waterproofing membrane.

Additionally, the waterproofing membrane 17 comprises a top non-stick mineral/polymer and silica sand layer, a first modified bitumen containing atactic polypropylene (APP) layer, a reinforced non-woven continuous fiber polyester mat stabilized with fiberglass thread spun bond polyester layer, a second APP layer, and a bottom torch off film as shown in FIG. 20. More specifically, the top non-stick mineral/polymer and silica sand layer is exposed to surrounding and provides a protective layer for the waterproofing membrane 17. The bottom torch off film is positioned adjacent to the elastic membrane 14 thus allowing the heat torch to bond the waterproofing membrane 17 to the elastic membrane 14. The first APP layer, the reinforced non-woven continuous fiber polyester mat stabilized with fiberglass thread spun bond polyester layer, and the second APP layer are respectively connected to each other from the top non-stick mineral/polymer and silica sand layer to the bottom torch off film thus forming the waterproofing membrane 17.

Figure 6:
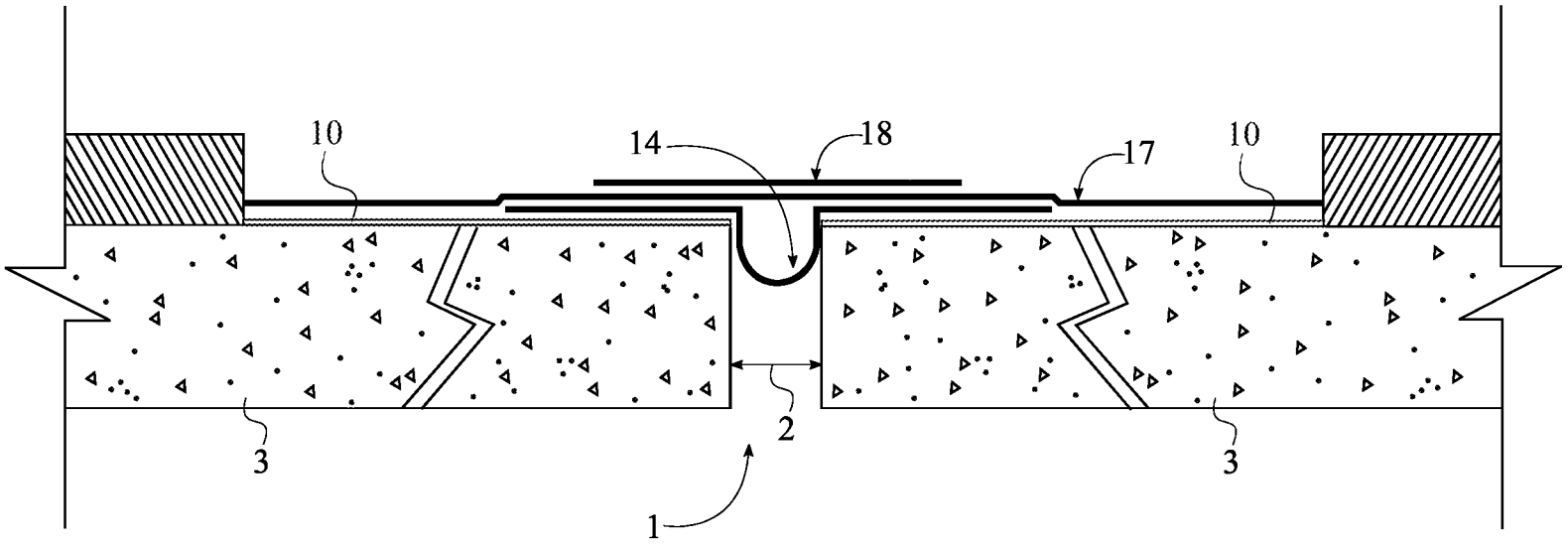
FIG. 6 is a schematic illustration showing adhering for the reinforced membrane within the present invention.
Figure 7:
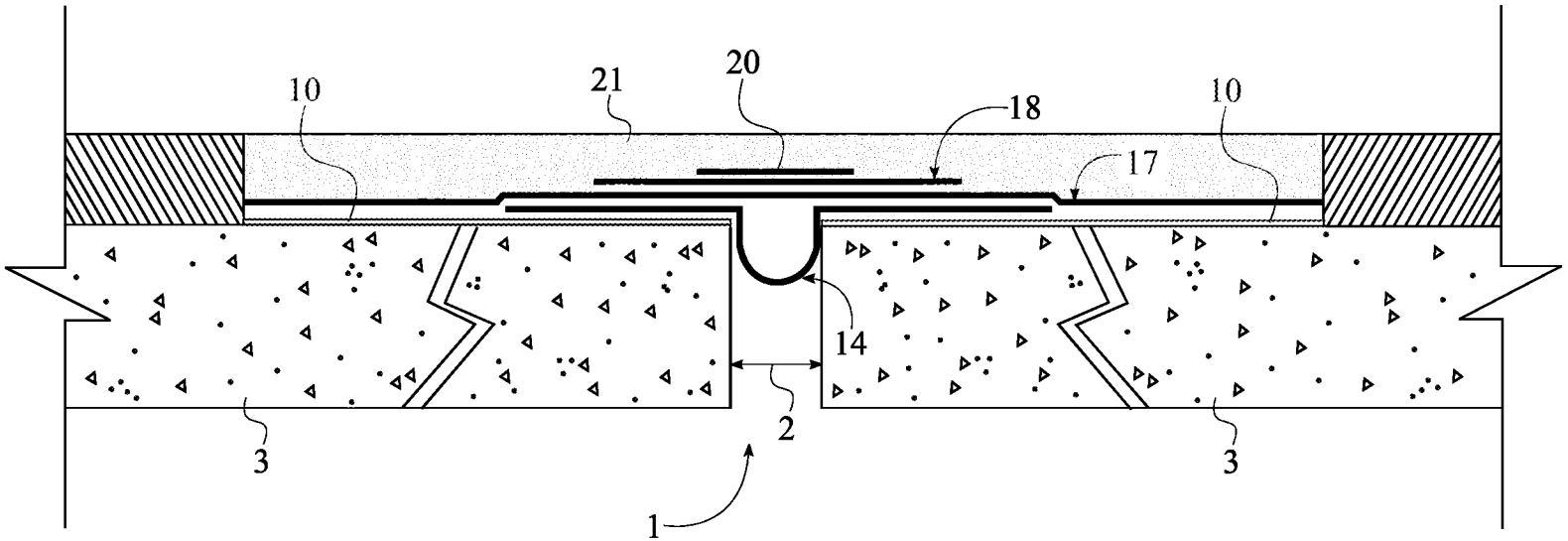
FIG. 7 is a schematic illustration showing the repaving process within the present invention in reference to the slip sheet and the layer of new asphalt concrete.
Figure 8:
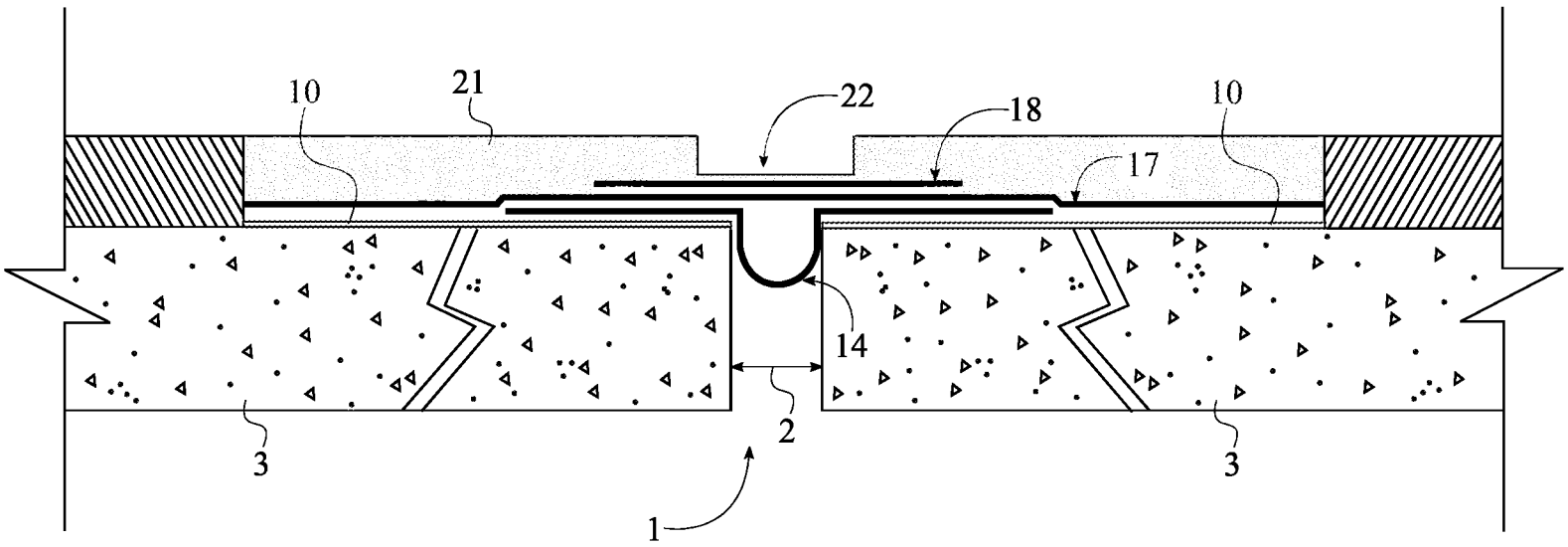
FIG. 8 is a schematic illustration showing the repaving process within the present invention in reference to the opening.
Figure 9:
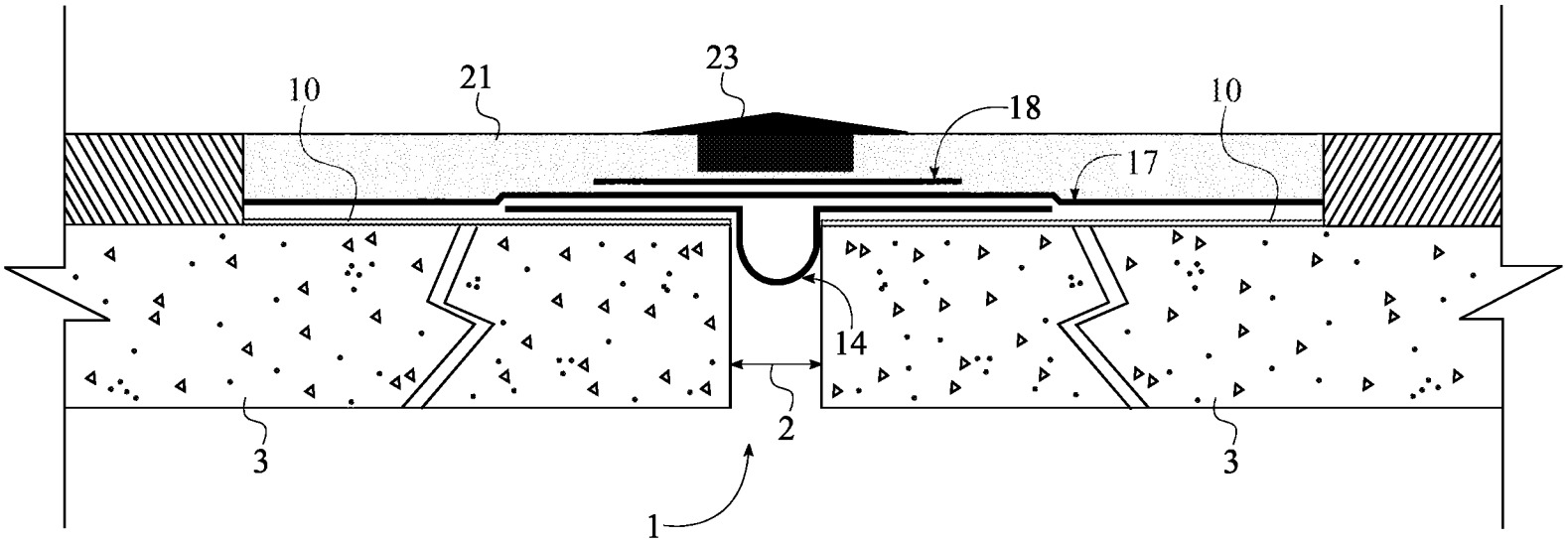
FIG. 9 is a schematic illustration showing the repaving process within the present invention in reference to the asphaltic plug.
Figure 16:
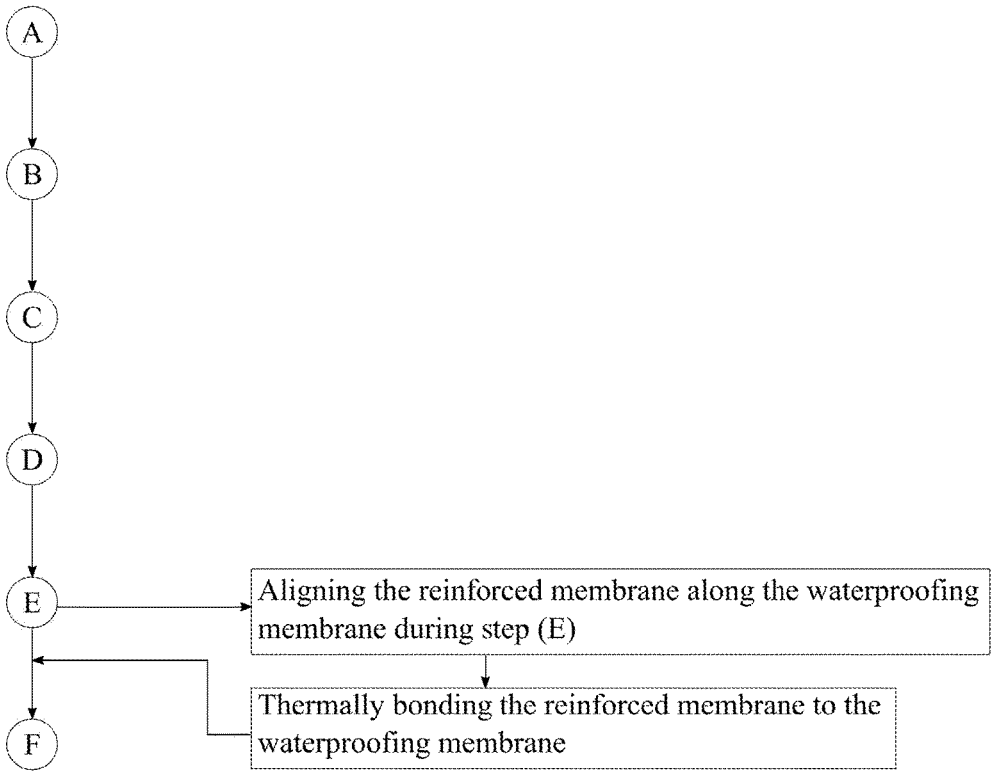
FIG. 16 is a basic flow chart illustrating the adhering of the reinforced membrane within the overall method of the present invention.
Figure 17:
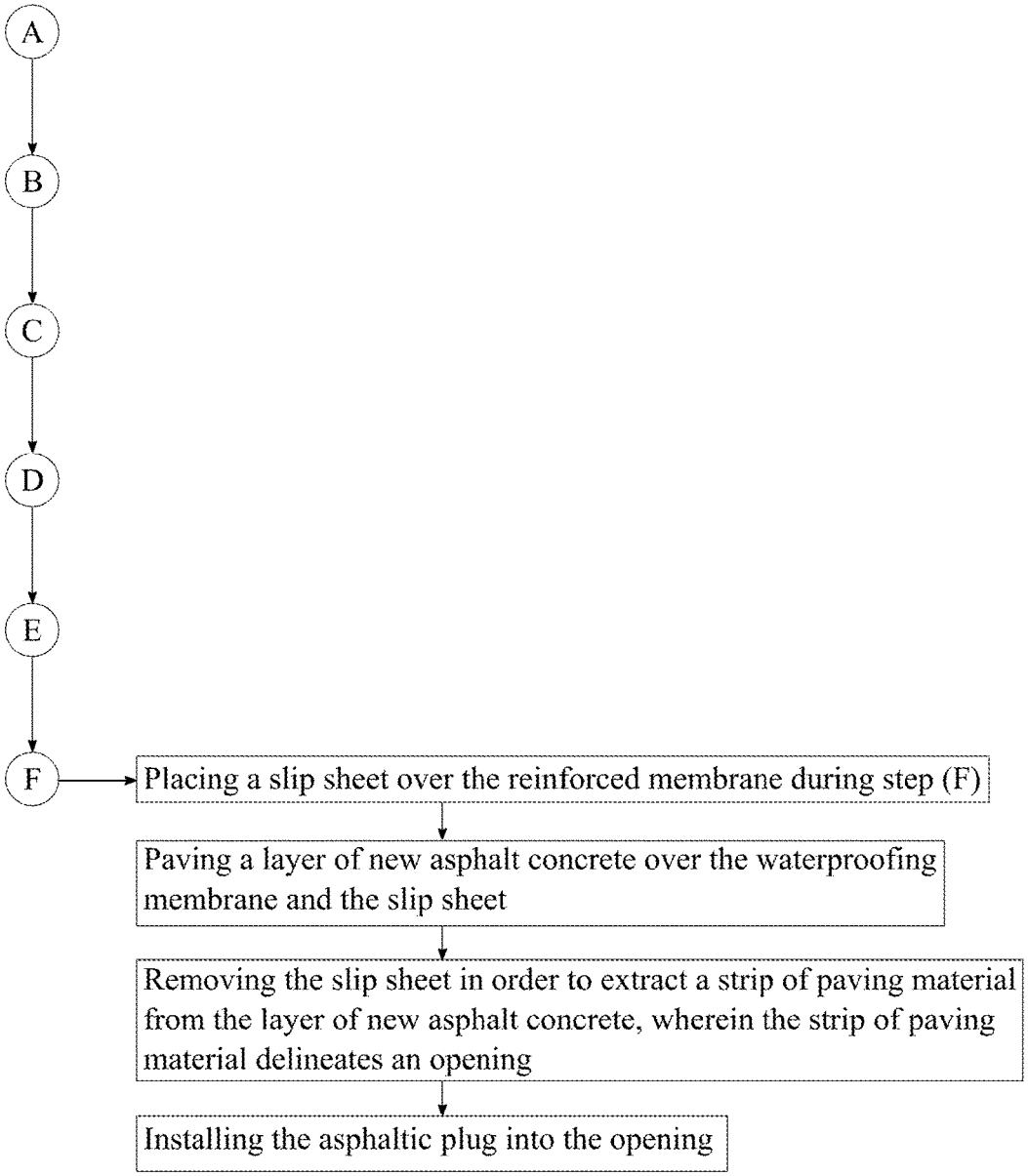
FIG. 17 is a basic flow chart illustrating the repaving process within the overall method of the present invention.

In reference to FIG. 6 and FIG. 16, as the fourth step, a reinforced membrane 18 is adhered onto the waterproofing membrane 17 along the bridge expansion joint 1 to increase the structural integrity of the elastic membrane 14 in relation to the intermediate section 15 and to provide stability for the bridge expansion joint 1 (Step E). More specifically, the reinforced membrane 18 is aligned along the waterproofing membrane 17 so that the reinforced membrane 18 is able fully cover the bridge expansion joint 1 while protecting the waterproofing membrane 17 and the intermediate section 15 of the elastic membrane 14 about the bridge expansion joint 1. The reinforced membrane 18 is then thermally bonded to the waterproofing membrane 17 with the heat torch to complete the adhering process of the waterproofing membrane 17.

Figure 21:
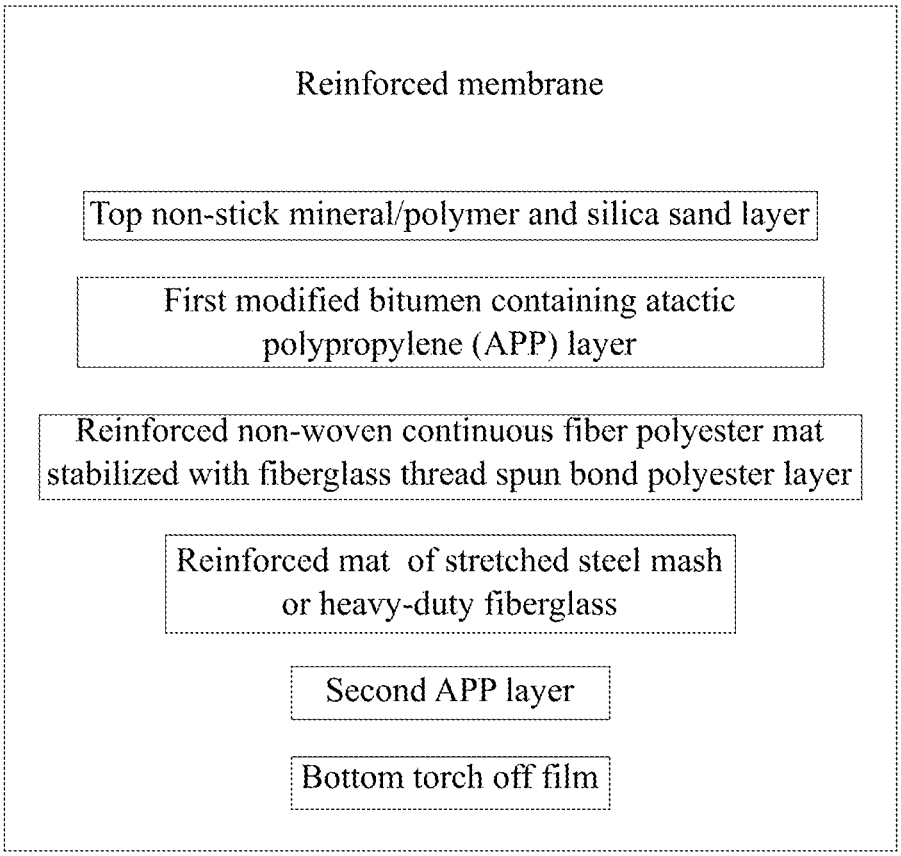
FIG. 21 is an illustration showing different layers of the reinforced membrane.

Additionally, the reinforced membrane 18 comprises a top non-stick mineral/polymer and silica sand layer, a first APP layer, a reinforced non-woven continuous fiber polyester mat stabilized with fiberglass thread spun bond polyester layer, a reinforced mat, a second APP layer, and a bottom torch off film as shown in FIG. 21. More specifically, the top non-stick mineral/polymer and silica sand layer is exposed to surrounding and provides a protective layer for the reinforced membrane 18. The bottom torch off film is positioned adjacent to the waterproofing membrane 17 thus allowing the heat torch to bond the reinforced membrane 18 to the waterproofing membrane 17. The first APP layer, the reinforced non-woven continuous fiber polyester mat stabilized with fiberglass thread spun bond polyester layer, the reinforced mat that can be made from stretched steel mash or heavy-duty fiberglass, and the second APP layer are respectively connected to each other from the top non-stick mineral/polymer and silica sand layer to the bottom torch off film thus forming the reinforced membrane 18.

Figure 10:
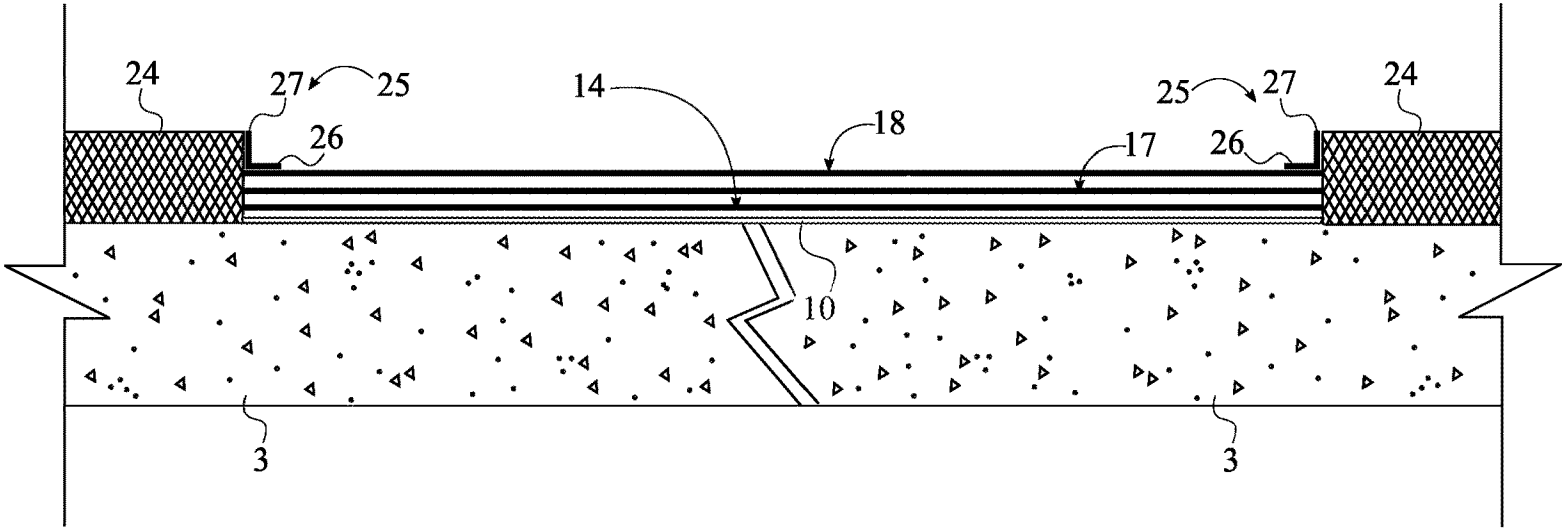
FIG. 10 is a schematic illustration showing the installation of the curb line splash-guard within the present invention.
Figure 18:
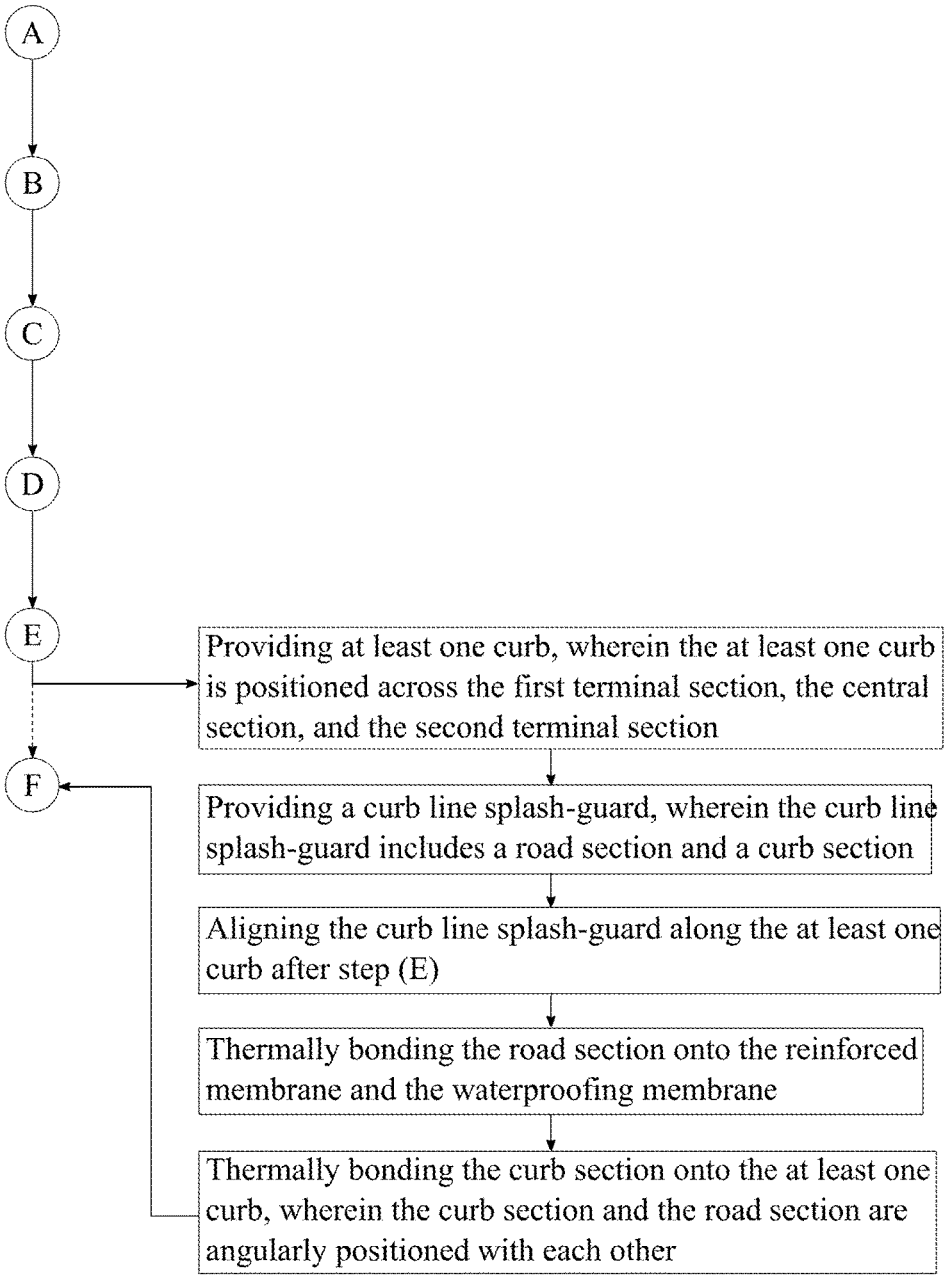
FIG. 18 is a basic flow chart illustrating the installation of the curb line splash guard within the overall method of the present invention.

Depending upon the location and structural components, the bridge structure may require a curb line splash-guard 25 to prevent chlorides and moisture penetration about an intersection between the bridge expansion joint 1 and at least one curb 24, wherein the curb 24 is positioned across the first terminal section 12, the central section 11, and the second terminal section 13. Once the reinforced membrane 18 is adhered onto the waterproofing membrane 17 along the bridge expansion joint 1, the curb line splash-guard 25 is aligned along the curb 24 so that the curb line splash-guard 25 can be adhered as shown in FIG. 10 and FIG. 18. More specifically, a road section 26 of the curb line splash-guard 25 that horizontally extends along the adjacent ends 3 is thermally bonded onto the reinforced membrane 18 and the waterproofing membrane 17. Then, a curb section 27 of the curb line splash-guard 25 that vertically extends along the curb 24 is thermally bonded onto the curb 24 as the curb section 27 and the road section 26 are angularly positioned with each other. Resultantly, the curb line splash-guard 25 captures any moisture that may drip down the curb 24 in order to protect the bridge expansion joint 1.

Figure 22:
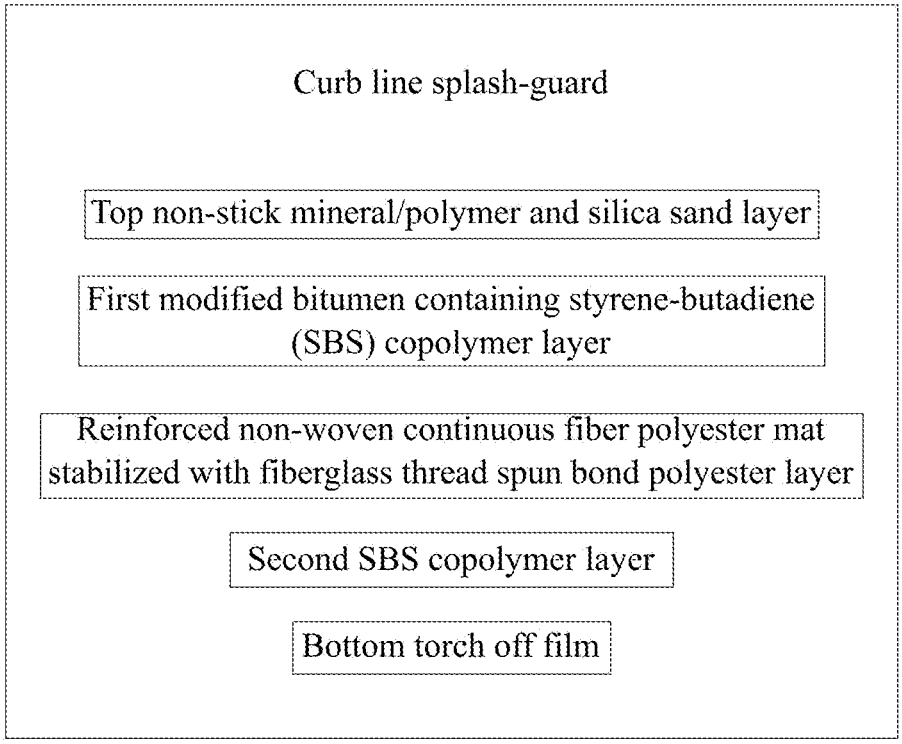
FIG. 22 is an illustration showing different layers of the curb line splash-guard.

Additionally, the curb line splash-guard 25 comprises a top non-stick mineral/polymer and silica sand layer, a first modified bitumen containing styrene-butadiene (SBS) copolymer layer, a reinforced non-woven continuous fiber polyester mat stabilized with fiberglass thread spun bond polyester layer, a second SBS copolymer layer, and a bottom torch off film as shown in FIG. 22. More specifically, the top non-stick mineral/polymer and silica sand layer is exposed to surrounding and functions a protective layer against moisture that is collect through the curb 24. The bottom torch off film is positioned adjacent to the reinforced membrane 18 and the waterproofing membrane 17 in reference to the road section 26 and to the curb 24 in reference to the curb section 27 thus allowing the heat torch to bond the curb line splash-guard 25. The first SBS copolymer layer, the reinforced non-woven continuous fiber polyester mat stabilized with fiberglass thread spun bond polyester layer, and the second SBS copolymer layer are respectively connected to each other from the top non-stick mineral/polymer and silica sand layer to the bottom torch off film thus forming the curb line splash-guard 25.

After the reinforced membrane 18 is adhered within the present invention, a repaving process 19 can be executed in order to install an asphaltic plug 23 as shown in FIG. 7-9 and FIG. 17 (Step F). More specifically, a slip sheet 20 is placed over the reinforced membrane 18 so that a layer of new asphalt concrete 21 can be paved over the waterproofing membrane 17 and the slip sheet 20. Once the paving process is completed for the bridge structure, the slip sheet 20 is removed to extract a strip of paving material from the layer of new asphalt concrete 21. As a result of the strip of paving material removal, the present invention delineates an opening 22 within the layer of new asphalt concrete 21. Furthermore, the slip sheet 20 protects the reinforced membrane 18 during the strip of paving material removal process. Then, the asphaltic plug 23 can be installed into the opening 22 thus completing the present invention.

When the gap 2 between the bridge expansion joint 1 exceeds 1 inch but no more than 4 inches, the present invention comprises a bridging plate for the maintain the structural integrity of the elastic membrane 14, the waterproofing membrane 17, and the reinforced membrane 18. More specifically, the bridging plate is used along span of the bridge expansion joint 1, to support traffic loads. The bridging plate can preferably form into following dimensions; 0.125 inch or 0.25 inch thickness, 8 inch width, and 48 inch length. Additionally, the bridging plate may comprise 3/16 inch diameter holes at the centerline of the bridging plate at 12 inch intervals to properly center the bridging plate over the bridge expansion joint 1. The bridging plate is positioned atop the elastic membrane 14 and along the bridge expansion joint 1. Then, locating pins are inserted through the 3/16 holes of the bridging plates and down into the gap 2 through the elastic membrane 14 to center the bridging plate along the bridge expansion joint 1. After the locating pins are installed, the waterproofing membrane 17, the reinforced membrane 18, and the repaving process 19 can be executed over the bridging plate in order to complete the method of the present invention.

Although the invention has been explained in relation to its preferred embodiment, it is to be understood that many other possible modifications and variations can be made without departing from the spirit and scope of the invention as hereinafter claimed.

What is claimed is:

1. A method for waterproofing a bridge expansion joint, the method comprises the steps of:

(A) providing a bridge expansion joint, wherein the bridge expansion joint is a gap between a pair of bridge decks or a bridge deck and a ground deck;

(B) applying a layer of primer onto adjacent ends from the pair of bridge decks;

(C) adhering an elastic membrane onto a central section of the layer of primer, wherein the central section is positioned along the bridge expansion joint;

(D) adhering a waterproofing membrane onto a first terminal section and a second terminal section of the layer of primer and the elastic membrane, wherein the first terminal section and the second terminal section are oppositely positioned of each other along the bridge expansion joint;

(E) adhering a reinforced membrane onto the waterproofing membrane along the bridge expansion joint; and (F) executing a repaving process in order to install an asphaltic plug.

2. The method for waterproofing a bridge expansion joint, the method as claimed in claim 1 comprises the steps of:

providing new construction of the adjacent ends during step (A);

cleaning the adjacent ends during step (B); and applying the layer of primer onto a concrete top surface of the adjacent ends.

3. The method for waterproofing a bridge expansion joint, the method as claimed in claim 1 comprises the steps of:

providing old construction of the adjacent ends during step (A), wherein the adjacent ends are covered with a layer of old asphalt concrete;

removing a blockout section from the layer of old asphalt concrete along the bridge expansion joint in order to expose a concrete top surface of the adjacent ends during step (B); and cleaning the adjacent ends; and applying the layer of primer onto a concrete top surface of the adjacent ends.

4. The method for waterproofing a bridge expansion joint, the method as claimed in claim 1 comprises the steps of:

aligning the elastic membrane along the central section during step (C), wherein the elastic membrane includes a pair of outer sections and an intermediate section;

placing the intermediate section within the bridge expansion joint in order to form an inverted dome shape; and thermally bonding the pair of outer sections to the central section.

5. The method for waterproofing a bridge expansion joint, the method as claimed in claim 1 comprises the steps of:

aligning the waterproofing membrane along the first terminal section, the elastic membrane, and the second terminal section during step (D); and thermally bonding the waterproofing membrane to the first terminal section, the elastic membrane, and the second terminal section.

6. The method for waterproofing a bridge expansion joint, the method as claimed in claim 1 comprises the steps of:

aligning the reinforced membrane along the waterproofing membrane during step (E); and thermally bonding the reinforced membrane to the waterproofing membrane.

7. The method for waterproofing a bridge expansion joint, the method as claimed in claim 1 comprises the steps of:

placing a slip sheet over the reinforced membrane during step (F);

paving a layer of new asphalt concrete over the waterproofing membrane and the slip sheet;

removing the slip sheet in order to extract a strip of paving material from the layer of new asphalt concrete, wherein the strip of paving material delineates an opening; and installing the asphaltic plug into the opening.

8. The method for waterproofing a bridge expansion joint, the method as claimed in claim 1 comprises the steps of:

providing at least one curb, wherein the at least one curb is positioned across the first terminal section, the central section, and the second terminal section;

providing a curb line splash-guard, wherein the curb line splash-guard includes a road section and a curb section;

aligning the curb line splash-guard along the at least one curb after step (E);

thermally bonding the road section onto the reinforced membrane and the waterproofing membrane; and thermally bonding the curb section onto the at least one curb, wherein the curb section and the road section are angularly positioned with each other.

9. The method for waterproofing a bridge expansion joint, the method as claimed in claim 1, wherein the elastic membrane includes a top non-stick mineral/polymer and silica sand layer, a first modified bitumen containing styrene-butadiene (SBS) copolymer layer, a reinforced non-woven continuous fiber polyester mat stabilized with fiberglass thread spun bond polyester layer, a second SBS copolymer layer, and a bottom torch off film.

10. The method for waterproofing a bridge expansion joint, the method as claimed in claim 1, wherein the waterproofing membrane includes a top non-stick mineral/polymer and silica sand layer, a first modified bitumen containing atactic polypropylene (APP) layer, a reinforced non-woven continuous fiber polyester mat stabilized with fiberglass thread spun bond polyester layer, a second APP layer, and a bottom torch off film.

11. The method for waterproofing a bridge expansion joint, the method as claimed in claim 1, wherein the reinforced membrane includes a top non-stick mineral/polymer and silica sand layer, a first modified bitumen containing atactic polypropylene (APP) layer, a reinforced non-woven continuous fiber polyester mat stabilized with fiberglass thread spun bond polyester layer, a reinforced mat, a second APP layer, and a bottom torch off film.

12. The method for waterproofing a bridge expansion joint, the method as claimed in claim 11, wherein the reinforced mat is made from stretched steel mash.

13. The method for waterproofing a bridge expansion joint, the method as claimed in claim 11, wherein the reinforced mat is made from heavy-duty fiberglass.

14. The method for waterproofing a bridge expansion joint, the method as claimed in claim 1, wherein the curb line splash-guard includes a top non-stick mineral/polymer and silica sand layer, a first modified bitumen containing styrene-butadiene (SBS) copolymer layer, a reinforced non-woven continuous fiber polyester mat stabilized with fiberglass thread spun bond polyester layer, a second SBS copolymer layer, and a bottom torch off film.

* * * * *